United States Patent [19]

Olson

[11] 4,200,146

[45] Apr. 29, 1980

[54] METHOD AND APPARATUS FOR HYDRAULICALLY DRIVING AND CONTROLLING A COOLING FAN

[75] Inventor: John R. Olson, Oconomowoc, Wis.

[73] Assignee: Dynex/Rivett Inc., Pewaukee, Wis.

[21] Appl. No.: 848,683

[22] Filed: Nov. 4, 1977

[51] Int. Cl.[2] ..... F01P 7/02

[52] U.S. Cl. ..... 165/39; 236/35; 123/41.12

[58] Field of Search ..... 236/35, 35.3, 34; 123/41.11, 41.12; 165/39

[56] References Cited

U.S. PATENT DOCUMENTS 4,036,432 7/1977 George ..... 236/35

*Primary Examiner*—Ira S. Lazarus
*Assistant Examiner*—Magdalen Moy
*Attorney, Agent, or Firm*—John J. Byrne

[57] ABSTRACT

A method and apparatus for hydraulically driving and controlling a cooling fan.

The apparatus includes a variable displacement hydraulic pump driven by a prime mover and a hydraulic motor connected to the pump and being driven thereby. The motor in turn is connected to a fan which serves to cool fluid passing through an associated heat exchanger. A temperature/force transducer monitors the temperature of fluid flowing from the exchanger and serves to control a pilot relief valve associated therewith. A pressure regulator is connected to the pump and acts in cooperation with the relief valve to control fluid pressure from the pump and thus torque of the motor and speed of the cooling fan.

The method includes the steps of pumping hydraulic working fluid to a motor and driving the motor with the full hydraulic output of the pump to power a fan associated with a cooling system heat exchanger. The method further includes the steps of sensing the temperature of fluid leaving the exchanger and controlling the pressure of fluid from the pump in response to the temperature of the fluid leaving the radiator and thereby hydraulically controlling the speed of the fan associated with the radiator.

5 Claims, 5 Drawing Figures

FIG. 1
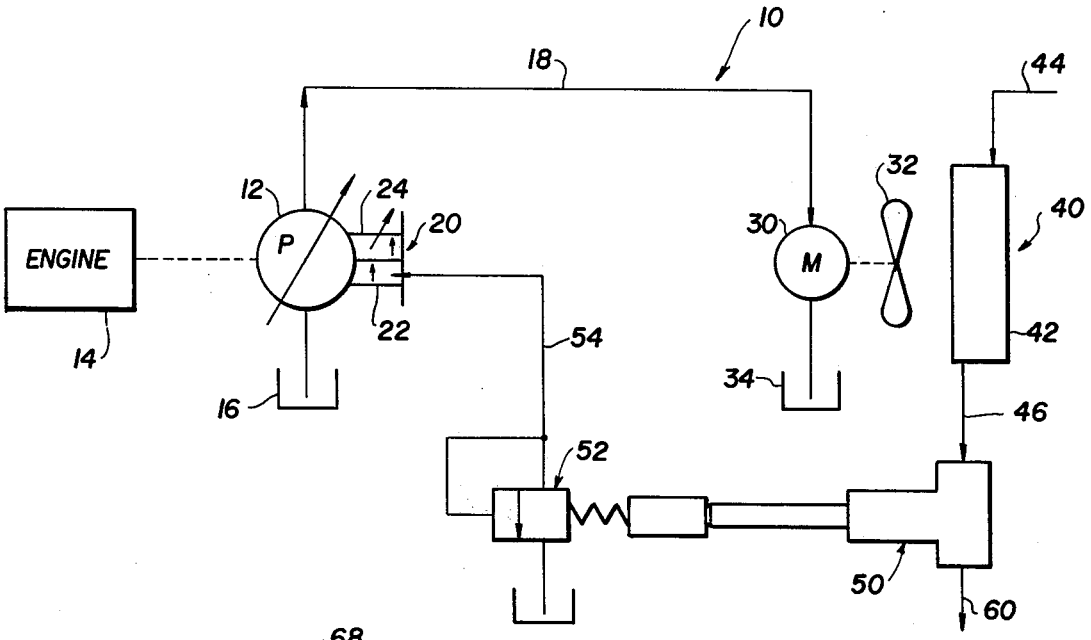
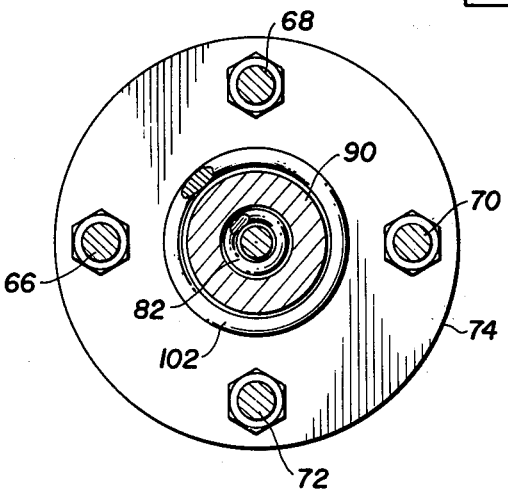
FIG. 4
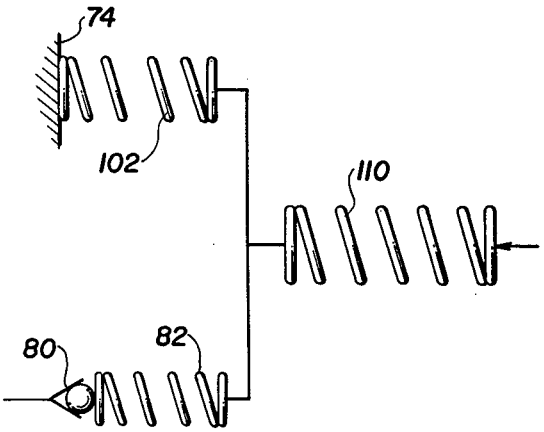
FIG. 5

METHOD AND APPARATUS FOR HYDRAULICALLY DRIVING AND CONTROLLING A COOLING FAN

BACKGROUND OF THE INVENTION

This invention relates to a method and apparatus for hydraulically controlling a fan associated with a fluid cooling system for a heat exchanger, high performance hydraulic working system, or the like.

In the past, various hydraulic systems have been known which are operable to drive a cooling fan for a heat exchanger. In one previously known system, a fixed delivery hydraulic pump is used to drive a hydraulic motor and cooling fan for an internal combustion engine. A relief valve is interposed in the hydraulic circuitry between the pump and motor and is operably connected to a temperature sensor which monitors the engine cooling system temperature. If the cooling system temperature is within a prescribed temperature range, hydraulic fluid from the pump is permitted to bypass the fan motor. In the event, however, the temperature of the cooled fluid exceeds a prescribed value, the relief value is actuated increasing pressure and thereby increasing the amount of working fluid delivered to the fan motor.

Although such a control system has at least a degree of theoretical appeal, a general disadvantage is that the input power to the pump comprises that utilized by the fan as well as that wasted in the fluid bypassing the relief valve, and that the energy of the wasted fluid is converted into heat within the hydraulic circuit.

Other previously known systems tend to provide for on-off control or control at various levels depending upon the cooling system temperature conditions. Although these systems have a place in the industry, variable control is highly desirable in many circumstances.

The difficulties suggested in the preceding are not intended to be exhaustive, but rather are among many which may tend to reduce the effectiveness of prior methods and apparatus for hydraulically controlling a cooling fan. Other noteworthy problems may also exist; however, those presented above should be sufficient to demonstrate that hydraulic control systems appearing in the past will admit to worthwhile improvement.

In the above connection, it would be highly desirable to provide a method and apparatus for driving and controlling a cooling fan which absorbs a minimum amount of power from the hydraulic drive, hence creating a minimum amount of power loss and heat generation. It will also be desirable to provide a control system wherein the hydraulic line from the pump to the motor is direct and does not require the insertion of devices to measure flow from the pump.

OBJECTS OF THE INVENTION

It is, therefore, a general object of the invention to provide a novel method and apparatus for hydraulically driving and controlling a cooling fan which will obviate or minimize prior difficulties while concomitantly providing desired features of the type previously described.

It is a particular object of the invention to provide a novel method and apparatus for hydraulically driving and controlling a cooling fan where a direct hydraulic line is maintained between a driving pump and a driven motor.

It is a further object of the invention to provide a novel method and apparatus for hydraulically driving and controlling a cooling fan where the fan torque and speed may be dynamically varied in response to variations of temperature of a fluid flowing through a radiator of an associated cooling system.

It is yet a further object of the invention to provide a novel method and apparatus for driving and controlling a cooling fan wherein fan torque and speed is independent of the speed of a prime mover in a system to be cooled.

It is still a further object of the invention to provide a novel method and apparatus for driving and controlling a cooling fan wherein a minimum amount of power is utilized in driving the system.

It is another object of the invention to provide a novel method and apparatus for hydraulically driving and controlling a cooling fan without inserting devices in the hydraulic line between a driving pump and a driven motor of the system.

THE DRAWINGS

Other objects and advantages of the present invention will become apparent from the following detailed description of a preferred embodiment thereof taken in conjunction with the accompanying drawings, wherein:

FIG. 1 is a schematic diagram of a hydraulic control system for a fan portion of a cooling system in accordance with preferred embodiment of the invention;

FIG. 4 is a cross-sectional view taken along section line 4—4 in FIG. 3 and discloses the concentric relationship of a pair of springs applied to preload a check valve and temperature/force transducer; and FIG. 5 is a schematic view of a spring arrangement of the relief valve and temperature/force transducer according to a preferred embodiment of the invention.

DETAILED DESCRIPTION

Figure 3:
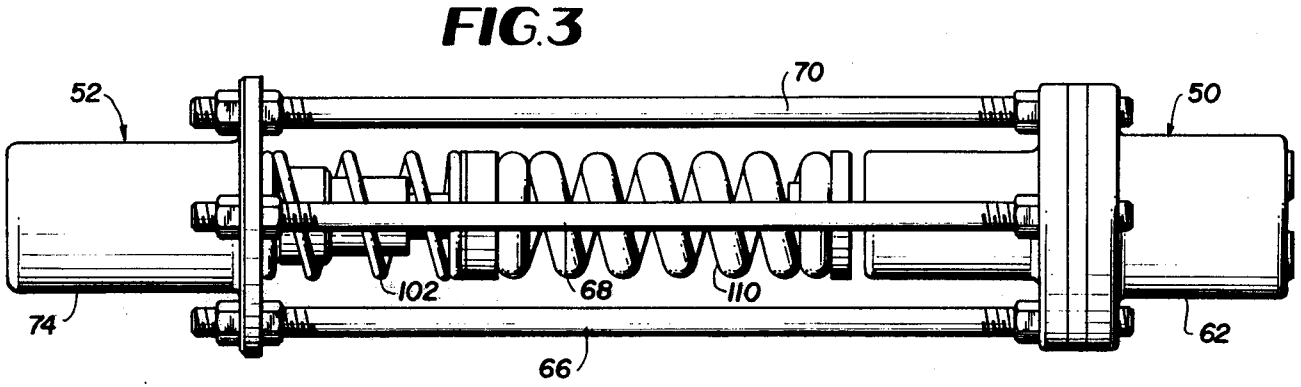
FIG. 3 is a top view of relief valve and temperature/force transducer means as previously shown in FIG. 2.

Referring now to the drawings and particularly to FIG. 1 thereof, a schematic diagram of a hydraulic control system 10 is depicted in accordance with a preferred embodiment of the invention.

The hydraulic control system 10 includes a variable delivery pump 12 which is driven by a prime mover 14. The pump 12 serves to draw hydraulic fluid from a sump 16 and pumps the fluid into a hydraulic line 18. The pump 12 is of a type wherein the fluid displacement may be varied in accordance with alterations in operating pressure of the pump.

The variable delivery pump 12 is fitted with a pressure compensation pump control 20 including a remote pressure control 22 and a master pressure control 24.

The structural features of the pump 12 and control 20 per se are known in the art and will therefore not be described in detail. Functionally, however, it is relevant to note that the pump 12 and control 20 are of the type wherein the pump maintains a set pressure independently of the hydraulic fluid flow required. Accordingly as the control 20 increases the pump operating pressure, the fluidic displacement of the pump will increase or decrease in delivering a volume of fluid to the line 18.

The hydraulic line 18 is connected directly to a fixed displacement motor 30 which drives a cooling fan 32 and returns the hydraulic fluid to a sump 34. The output torque from this type motor is a function of the displacement of the motor 30 and the pressure applied. The torque needed to drive the fan 32 is a function of its speed. Accordingly increasing the hydraulic pressure on the motor 30 will increase the speed of the fan 32.

The fan 32 is a part of a cooling system 40 where air is driven through a heat exchanger 42 as the cooling fluid flows through the heat exchanger. In accordance with conventional hydraulic cooling systems heated fluid to be cooled is input into the exchanger through line 44. As the heated fluid follows a tortious internal path through the exchanger, cooling air is blown through an external path through the exchanger by the fan 32. If increased cooling is needed the speed of the fan is increased to drive a greater volume of air through the external exchanger path. The cooled fluid departs from the exchanger via line 46.

The temperature of cooled fluid leaving the exchanger in line 46 is continuously monitored by a temperature/force transducer 50. The transducer 50 in turn is connected to a relief valve assembly 52.

The relief valve assembly 52 in turn is hydraulically connected by line 54 to the remote pressure control 22 of the pump pressure compensator 20.

The pump pressure compensator 20 comprises a master pressure compensator 24 preset to the maximum allowable pressure and a remote pressure regulator 22. The relief valve assembly 52 allows pressure to be set for the remote pressure control 22 and thus serves to regulate the operating pressure of the pump 12 in response to variations in the temperature of the cooling fluid leaving the exchanger.

Figure 2:
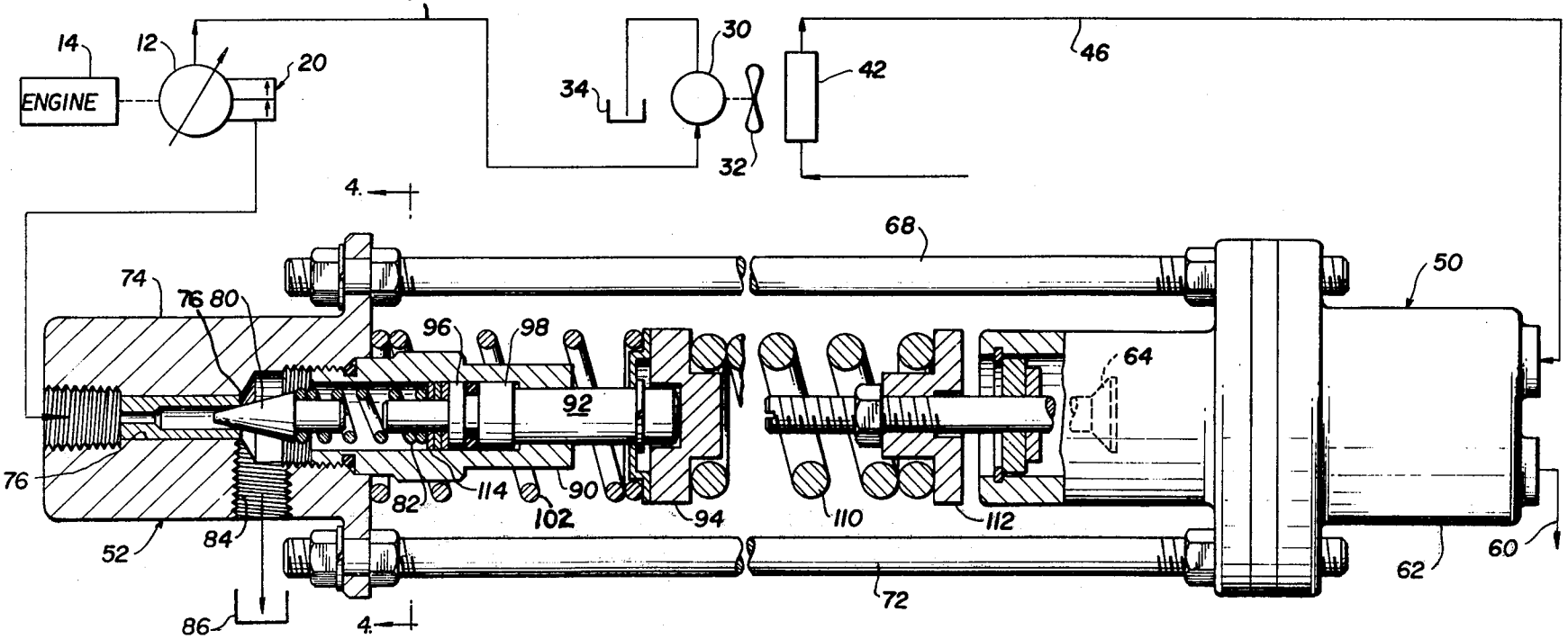
FIG. 2 is a more detailed schematic diagram of a hydraulic control system with a relief valve and temperature/force transducer means shown in a partially sectioned side elevational view.

Turning now to FIGS. 2 and 3 there will be seen views which disclose in more detail the structural features of the relief valve and temperature/force transducer aspects of the invention.

As represented in FIG. 2 and as previously discussed above the control system includes a variable displacement pump 12 which is controlled by a pressure compensator 20. Hydraulic output from the pump 12 is applied directly to a fixed delivery motor 30. The motor 30 is mechanically coupled to a cooling fan 32 associated with the heat exchanger of a cooling system. Fluid cooled by the exchanger passes via return line 46 through a temperature/force transducer 50 and on to the cooling jacket of a prime mover or the like not shown via line 60.

The temperature/force transducer 50 includes a cylindrical housing 62 for receiving the cooled fluid from the heat exchanger 42. A piston 64 is mounted within the transducer 50 and serves to transmit force and stroke generated within the transducer in direct response to thermal variations in the cooling fluid. The mechanical output piston 64 of the transducer 50 can be directly coupled to an input stem 92 of the relief valve 52 if the transducer 50 stroke and force output matches those required by the input stem 92 of the relief valve 52. If the match cannot be made, the transducer can be mechanically coupled together as shown in FIG. 2 and FIG. 3, utilizing a combination of springs as shown in FIG. 5.

The cylindrical housing 62 of the temperature/force transducer is connected through the provision of connecting rods 66, 68, 70 and 72 to the housing 74 of the relief valve means 52.

The relief valve housing 74 includes a first axial bore 76 which terminates in a valve seat 78. A tapered poppet valve 80 is positioned within the bore 76 and is resiliently biased against the valve seat by a compression spring 82. A radial bore 84 is also formed within the relief valve housing 74 down stream of the valve seat 78 and serves to vent hydraulic fluid passing between valve 80 and seat 78 to a sump 86.

A cylinder 90 is coaxially mounted within the bore 76 at the down stream side of the relief valve and carries a reciprocating stem 92 which is connected at an outward end to a bearing collar 94 and carries on an inward end a pair of discs 96 and 98 separated by an annular packing member 100.

The relief valve spring 82 reacts between the back side of the valve 80 and the disc 96 as shown in FIG. 2. Accordingly movement of the stem 92 to the left as viewed in FIG. 2 will serve to compress spring 82 and increase the line pressure needed to open valve 80.

Another compression spring 102 coaxially surrounds the valve cylinder 90, note FIGS. 2 and 4, and reacts at one end against the relief valve housing 74 and at the other end against the bearing collar 94. Accordingly compression springs 82 and 102 act in parallel in a manner which will be discussed more fully below.

A third compression spring 110 may be utilized between the bearing collar 94 and a stepped collar 112 which is connected to an outward end of piston 64.

As depicted in FIG. 5 the springs 82 and 102 are mounted within the assembly in parallel and then in turn in series with spring 110.

In order to adjust transducer actuation the spring 102 may be preloaded by tightening up on threaded fasteners connected to each of the coupling rods 66–72.

In a similar vein the valve spring 82 may be set or preloaded by adding an appropriate number of shims 114 between the disc 96 and the spring 82.

In operation the prime mover 14 serves to drive the variable delivery pump 12 which draws hydraulic fluid from the sump 16 and delivers the fluid directly to the fixed delivery motor 30. The fixed delivery motor 30 is mechanically coupled to a cooling fan 32 which is associated with a heat exchanger of an external cooling system.

The variable delivery pump 12 is controlled by a pressure compensator control 20 and serves to vary fluid displacement from the pump in accordance with pump operating pressure. An increase in hydraulic displacement from the pump serves to increase the torque of the motor and speed of the fan 32.

Cooled fluid from the exchanger 42 is continuously monitored by a temperature/force transducer 50. Concomitantly the pressure compensation control 20 is connected through a remote pressure compensation control 22 to a relief valve 52 which serves to vent excess pressure from the control to a sump 86.

In the event a fluid temperature is sensed at the radiator outlet in excess of a desired valve the temperature/force transducer 50 will function through preloaded spring 102 to increase the reaction force of the relief valve spring 82 by moving stem 92 to the left as viewed in FIG. 2. Accordingly the pressure in control 20 will increase and the pressure in line 18 will increase. The increase in pressure applied to the motor 30 will cause the fan 32 to increase in speed. The increase in flow required by the motor 30 is automatically made by pressure compensator control 20 acting on the variable deliver pump 12.

Once the radiator temperature becomes sufficient to activate the termperature/force transducer control the fan speed is dynamically continuous and proportional to the increase in temperature of fluid flowing through the radiator. As previously noted this actuation point may be predetermined by presetting spring 102. Moreover the initial actuation point of the valve spring 82 may be established by the number of shims 114 utilized. In a preferred form of the invention the shims are set to provide for slight valve looseness thus permitting a continuous venting of fluid from the pressure control to the sump 86.

In describing a method and apparatus for hydraulically driving and controlling a cooling fan in accordance with a preferred embodiment of the invention those skilled in the art will recognize several advantages which singularly distinguish the subject invention from previously known devices.

A particular advantage is the provision of a hydraulic method and apparatus where a direct line is provided between a driving pump and a driver fan motor. The variable delivery pump and the fixed delivery motor enables the motor torque and hence fan speed to be regulated by controlling fluid pressure applied to the motor. Since the hydraulic line is direct there is no need to insert devices to measure flow from the pump as required on some prior devices.

Another significant feature is the provision of continuous dynamic fan conrol which will utilize a minimum amount of system power. The fan is further independent of the speed of an external prime mover and is directly controlled by a desired cooling fluid operating temperature.

In describing the invention, reference has been made to a preferred embodiment. Those skilled in the art, however, and familiar with the disclosure of the subject invention, may recognize additions, deletions, modifications, substitutions and/or other changes which will fall within the purview of the invention as defined in the following claims.

What is claimed is:

1. An apparatus for hydraulically driving and controlling a cooling fan comprising:

a working hydraulic fluid loop including, pump means driven by a prime mover and having a first working output and a second control output means, said pump means being operable for pumping hydraulic fluid from a sump to said first and second output means, said pump means comprising a variable delivery pump wherein the fluidic displacement from the pump to said first output means is controlled by regulating the operating pressure thereof, and motor means for driving a cooling fan, said motor means being connected directly to said first output means of said pump means and being continuously driven directly by the hydraulic output from said first output means and thereafter said motor means returning the hydraulic fluid to a sump, said motor means comprising a fixed delivery motor wherein the torque of said motor means is a direct function of fluid displacement and pressure from said first output means from said pump means;

means external of said hydraulic fluid loop for sensing the temperature of fluid passing through a heat exchanger associated with the cooling fan, said means comprising a temperature/force transducer means connected to a relief valve means for regulating said relief valve means in response to variations in the temperature of fluid passing through the heat exchanger; and means for variably controlling said pump means and thus the torque of said motor means as a function of the fluid temperature passing through the heat exchanger, said means for variably controlling comprises a pressure compensation regulator connected to said variable delivery pump and hydraulic and relief valve means connected to said pressure compensation regulator for controlling the pressure of said regulator, wherein an increase in sensed fluid temperature will produce an increase in pressure applied to said motor means and an increase in cooling fan speed while a decrease in sensed fluid temperature will produce a decrease in pressure applied to said motor means and decrease in cooling fan speed.

2. An apparatus for hydraulically driving and controlling a cooling fan as defined in claim 1 wherein said relief valve means includes:

spring means connected to a valve in said relief valve means for biasing the relief valve in a normally closed posture and preloading the valve against actuation until a preselected hydraulic control line pressure is achieved.

3. An apparatus for hydraulically driving and controlling a cooling fan as defined in claim 2 wherein said relief valve means further comprises:

spring means connected to said temperature/force transducer for preloading said temperature/force transducer and preventing actuation thereof until a predetermined force level is achieved.

4. A method for hydraulically driving and controlling a cooling fan comprising the steps of:

pumping hydraulic working fluid to a motor;

driving the motor with the hydraulic output of the pump;

driving a fan connected directly to the motor;

cooling fluid passing through a heat exchanger positioned adjacent the fan;

sensing the temperature of fluid leaving the heat exchanger; and controlling the pressure of hydraulic fluid from the pump in response to the temperature of fluid leaving the heat exchanger by bleeding fluid from a pump pressure compensator through a relief valve in response to the temperature of fluid leaving the heat exchanger, wherein an increase in the temperature of the fluid leaving the heat exchanger will cause a greater pressure of hydraulic fluid in the line leading to the motor to increase the torque of the motor and speed of the fan to cool fluid passing through the heat exchanger.

5. A method for hydraulically driving and controlling a cooling fan as defined in claim 4 wherein said step of regulating the pressure of a pressure regulator further comprises the steps of:

preloading the relief valve to bleed fluid from the pressure compensator after a predetermined pressure is reached; and preloading a temperature/force transducer connected to the relief valve and responsive to variations in temperature of fluid leaving the heat exchanger.

* * * * *